US005961118A

United States Patent [19]

Chie et al.

[11] Patent Number: 5,961,118

[45] Date of Patent: Oct. 5, 1999

[54] STRATEGY BOARD GAME

[76] Inventors: Nancy K. Chie; Robert M. Chie, Jr.; Wredee B. Chie, all of 222 Massachusetts Ave. apt. A, Trenton, N.J. 08609

[21] Appl. No.: 09/002,092

[22] Filed: Dec. 31, 1997

[51] Int. Cl.[6] ..... A63F 3/00

[52] U.S. Cl. ..... 273/264

[58] Field of Search ..... 273/243, 264, 273/282.1, 268

[56] References Cited

U.S. PATENT DOCUMENTS

| | | | |
|---|---|---|---|
| 1,465,160 | 8/1923 | Di Fuchio | 273/264 |
| 3,190,655 | 6/1965 | Louie | 273/264 |
| 4,063,734 | 12/1977 | Taylor | 273/264 |
| 4,579,347 | 4/1986 | Reman | 273/264 |
| 4,813,681 | 3/1989 | Volpert, Jr. . | |
| 4,852,887 | 8/1989 | Li | 273/264 |
| 5,064,201 | 11/1991 | Smith | 273/264 |
| 5,248,149 | 9/1993 | Tarrats . | |
| 5,277,419 | 1/1994 | Craig . | |
| 5,318,307 | 6/1994 | Bouchard et al. . | |
| 5,433,448 | 7/1995 | Raphael et al. . | |
| 5,497,997 | 3/1996 | Nikas et al. | 273/264 |
| 5,687,970 | 11/1997 | Clark | 273/264 |

*Primary Examiner*—William E. Stoll
*Attorney, Agent, or Firm*—Richard C. Litman

[57] ABSTRACT

A strategy board game for two players comprises a game board having a square matrix of playing positions thereon, with each player having a number of player position markers equal to the number of positions in any given row, column, or diagonal of the board. Each player's markers are initially positioned along the horizontal row of the board adjacent the respective player, with each player alternatingly moving one marker to one adjacent position of the board during each turn. The object of the game is for a player to attain a straight line of markers along any one of the rows (except the starting row), columns, or diagonals of the game board. While the game superficially resembles tic-tac-toe, the rules of play are considerably different, in that each of the markers may be moved any number of times as desired by the controlling player, and may even be returned to the starting row or position if desired. Alternative embodiments provide for game boards having three by three, four by four, and five by five arrays of positions respectively comprising nine, sixteen, and twenty five positions, with the positions being contiguous or being separated by paths or lanes designating the permissible movement of markers between positions.

10 Claims, 7 Drawing Sheets

STRATEGY BOARD GAME

BACKGROUND OF THE INVENTION

1. Field of the Invention

The present invention relates generally to games of mental skill, and more specifically to a board game for two players, involving the alternating movement of position markers on a predetermined array of playing positions. The object is to be the first player to arrange his or her playing pieces to form a vertical, lateral, or diagonal line across the game board.

2. Description of the Related Art

Games involving mental skill, and particularly board games, have been known for centuries. Such games have developed and evolved as a pastime for players, and provide a generally enjoyable mental challenge for participants. While a vast number of such games have been developed over the years, generally speaking, those games with relatively simple rules, yet having relatively complex strategies of play between two or more players, have been found to have the greatest durability and longevity and to provide the greatest enjoyment for players over the years. Chess, checkers, and the oriental game of go are examples of such games.

Another such game employing relatively simple rules, and somewhat more closely related to the present game, is the game of tic-tac-toe, which has been played informally for decades. In tic-tac-toe, a three by three grid of nine playing positions is marked out (generally with the outer borders of the positions omitted, but understood), with two players alternating turns by marking an "X" or an "O" within the initially empty playing positions. The object is to be the first player to achieve an alignment of three "X" or "O" marks (depending upon the player) either vertically, laterally, or diagonally across the grid. The game is relatively simple and is quite restricted, as once a player places his or her mark in an empty position on the grid, that mark cannot be moved or deleted. Thus, strategy is relatively simple, with the first player to place a mark having a distinct advantage over the second player.

The present game uses a similar grid matrix of playing positions and requires a player to align his/her position markers vertically, laterally, or diagonally across the board, but requires that each player begin the game with a number of movable markers along their respective first or starting lateral row or file of the board. The two players then alternatingly move one marker in each turn, attempting to align a complete row of markers vertically, laterally, or diagonally across the board. The markers of the present game may be moved any number of times, one position in each turn to any adjacent vacant position on the board, as in the move pattern permitted for a king in chess. Thus, the present game requires considerably more strategy than the game of tic-tac-toe.

A discussion of further related art of which the present inventor is aware, comprising related issued U.S. Patents and their differences and distinctions from the present board game invention, is provided immediately below.

U.S. Pat. No. 4,813,681 issued on Mar. 21, 1989 to Thomas R. Volpert, Jr. describes a Method Of Playing An Alignment Game, having a board with a four by four matrix of sixteen positions and with each player having four position markers. A different marker is used to mark the starting position for a given game. Players place their markers on the board in turn, with each first play being on a non-diagonal position adjacent to the starting marker. The object is as in tic-tac-toe, i.e., to align three of a player's markers in a row, column, or diagonal. However, Volpert, Jr. makes no provision for moving the markers after their initial placement on the board, as provided by the present game. Thus, the Volpert, Jr. game is limited to a total of four moves by each player, whereas the moves of the present game are unlimited in principle.

U.S. Pat. No. 5,248,149 issued on Sep. 28, 1993 to Edward Tarrats describes a Method Of Playing Tic-Tac-Toe With Cards, in which the position markers comprise cards drawn randomly from a deck. A player drawing an opponent's card may place that card atop an opponent's card which has already been played. Tarrats describes other cards which when played atop an already used position, allow that position on the board to be used again. However, no moving of cards is permitted once they have been played, as permitted in the present game.

U.S. Pat. No. 5,277,419 issued on Jan. 11, 1994 to Paul Craig describes a Method Of Playing A Three Dimensional Game, comprising a three by three by three matrix of playing positions in mutually orthogonal X-Y-Z axes to form a three dimensional playing volume. Each player has a plurality of playing position markers, including a "star" marker for each player, which may only be played on one of a relatively few positions of the matrix. The object is to align three rows of markers in any three rows, columns, or diagonals of the matrix, with one of the alignments including a star marker and position. Thus, the game resembles a combination of the three dimensional tic-tac-toe game of Qubic (tm), and the tic-tac-toe like game of Volpert, Jr., described further above. Craig does not provide for any movement of a position marker after its initial placement in the matrix, as provided by the present game. Thus, the number of plays permitted in the Craig game are limited to the number of position markers provided to each player.

U.S. Pat. No. 5,318,307 issued on Jun. 7, 1994 to Marcel Bouchard et al. describes a Super Tic-Tac-Toe Tossing Game, including a three by three matrix of nine playing positions. Each player has lighter and heavier position markers, with the lighter markers first being tossed into the matrix. The heavier markers are then tossed, with players attempting to dislodge the opponent's lighter markers. The object is as in tic-tac-toe, but the markers cannot be moved after placement (except once, by being dislodged by an opponent's heavier marker), whereas the present game allows any of the markers to be moved any number of times and to any position.

Finally, U.S. Pat. No. 5,433,448 issued on Jul. 18, 1995 to Stewart C. Raphael et al. describes a Three Dimensional Tic-Tac-Toe Game somewhat similar to the game of the Craig '419 U.S. Patent and the well known game of Qubic (tm) noted further above. However, the Raphael et al. game comprises a three by three by three matrix, as in the Craig game, rather than the four by four by four matrix of the Qubic game. The Raphael et al. game is played in the same manner as Qubic and tic-tac-toe, with the object being to align three markers along any horizontal or vertical row, column, or diagonal. The Raphael et al. game uses a frame or lattice adapted to hold a plurality of blocks therein, by means of Velcro (tm) or the like, rather than comprising a series of flat trays upon which markers may be placed. While the structure is different from conventional tic-tac-toe, the rules of play are the same, and differ from the rules of the present invention in that Raphael et al. do not permit any movement of a marker once it has been placed in the matrix.

None of the above inventions and patents, either singly or in combination, is seen to describe the instant invention as claimed.

SUMMARY OF THE INVENTION

The present invention comprises a strategy board game resembling the old game of tic-tac-toe, but incorporating different rules allowing multiple movement of each of the markers used in the game. Several embodiments are disclosed herein, incorporating different numbers and arrangements of playing positions on the board.

The game is played using a square matrix of playing positions (three by three, four by four, five by five, etc.) on a game board. Each player has a quantity of position markers or chips equal to the number of playing positions in a given row or column of the game board, e. g., four markers for a game board having a four by four matrix of sixteen playing positions. The two opposite players place their markers along their respective starting rows, i. e., the lateral row of playing positions closest to the respective player. Each player in turn then moves one marker, one position at a time, while attempting to position all of his/her markers to form a straight, continuous line along one of the lateral rows (other than the starting row), vertical columns, or diagonals of the board. The first player to succeed is the winner.

However, any of the markers may be moved any number of times during the course of the game, and may even be moved back to the starting position if so desired. Thus, each player may continually adjust his or her position as desired on the board, depending upon the pattern of markers of the opposite player as the game evolves. An alternative game board connects each of the playing positions with a path or lane along which the markers are moved, with some positions being indirectly connected, i. e., with movement between the two positions requiring movement to at least a third intermediate position before the marker may be positioned as desired.

Accordingly, it is a principal object of the invention to provide an improved strategy board game comprising a square matrix of playing positions having an equal number of playing positions in each lateral row, vertical column, and diagonal, along with a number of position markers for each player equal to the number of playing positions in each row, column, or diagonal.

It is another object of the invention to provide an improved strategy board game in which adjacent playing positions may be in mutual contact and share common borders, or which may be separated by playing paths or lanes therebetween.

An additional object of the invention is to provide an improved strategy board game in which the playing paths or lanes may not connect all adjacent playing positions directly, but which may require marker movement to an intermediate position before reaching the desired position.

It is a further object of the invention to provide an improved strategy board game in which the game board may comprise a three by three, four by four, or five by five matrix respectively having nine, sixteen, or twenty five playing positions, or other square matrix of playing positions, as desired.

Still another object of the invention is to provide an improved method of playing a board game having a square matrix of playing positions and requiring the alignment of one set of player position markers along any row, column, or diagonal of the game board, and providing for each of the markers to be moved any number of times by the controlling player, as desired.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
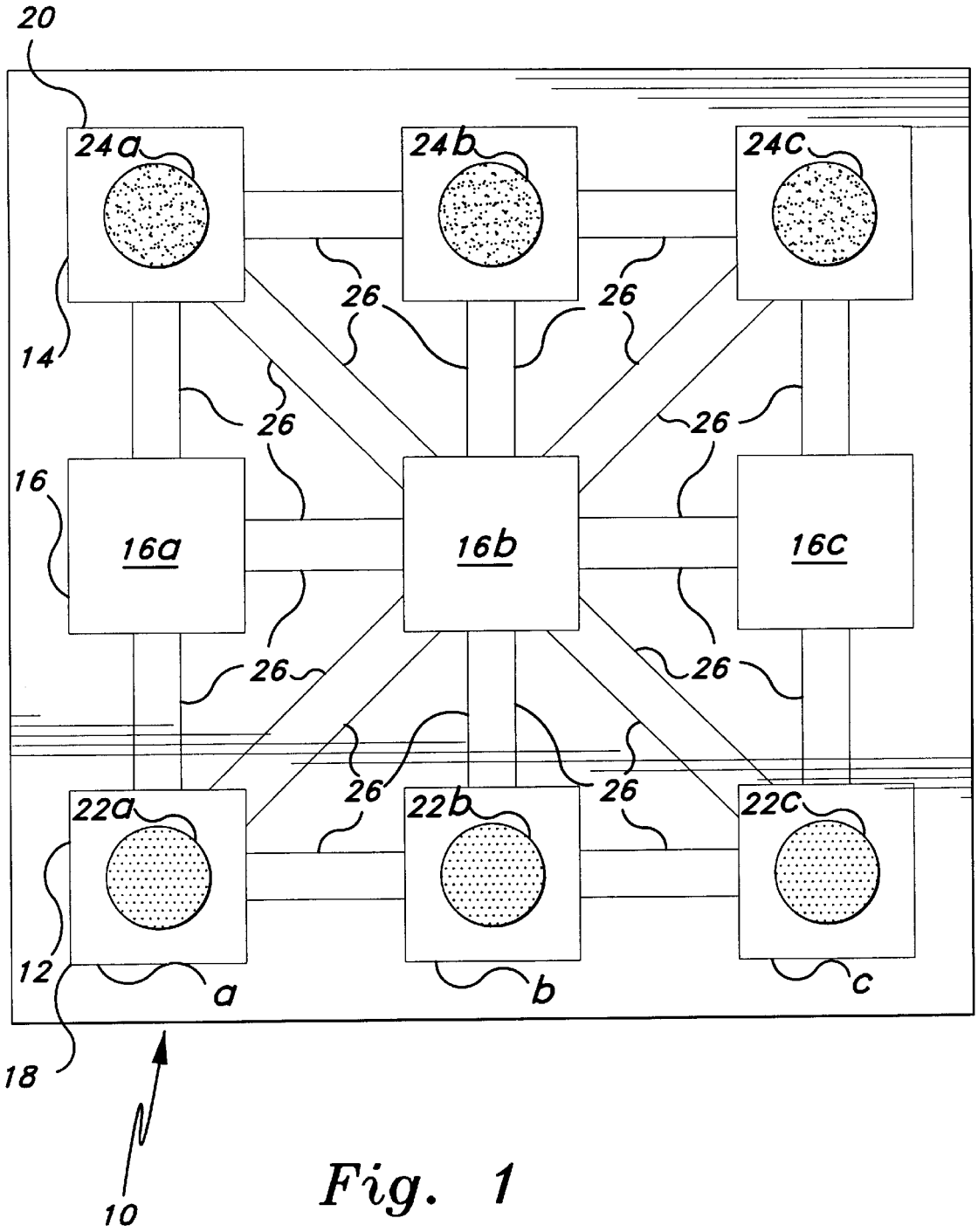
FIG. 1 is a plan view of a first embodiment of the game board of the present strategy board game, illustrating a three by three matrix of nine playing positions with adjacent positions separated by playing paths or lanes therebetween.

The present invention comprises a strategy board game, with a first embodiment 10 of a game board being shown in FIG. 1. The game board 10 of FIG. 1 comprises a square matrix of nine separate, spaced apart playing positions thereon, with the board 10 having three horizontal rows comprising a first starting row 12, an opposite second starting row 14, a single intermediate row 16, and three vertical columns comprising first through third columns a, b, and c. A first and a second major diagonal, respectively 18 and 20, extend to diagonally opposite corners of the board 10. Further embodiments comprising higher numbers of playing positions and other arrangements, are disclosed in other drawing figures.

Throughout the present disclosure, the individual playing positions of each of the game board embodiments will be designated using the reference numerals from their respective row and column, with the horizontal row numeral shown first. Thus, the central playing position of the game board 10 of FIG. 1 is designated as position 16*b*, with the lower left position being designated as position 12*a*, the upper right position being designated as position 14*c*, etc.

The two players of the game are each provided with a separate, distinct set (differently colored, shaped, etc.) of player position markers, respectively 22*a*, 22*b*, and 22*c* for the first marker set and 24*a*, 24*b*, and 24*c* for the second marker set for the game board 10 of FIG. 1. The number of markers in each marker set for each of the game embodiments disclosed herein, is exactly equal to the number of playing positions in each row, column, or major diagonal of the game board. Thus, the three by three matrix game board 10 of FIG. 1 will include three player position markers in each set 22 and 24, with a board having a four by four matrix of player positions also having four markers in each set, etc.

Figure 7:
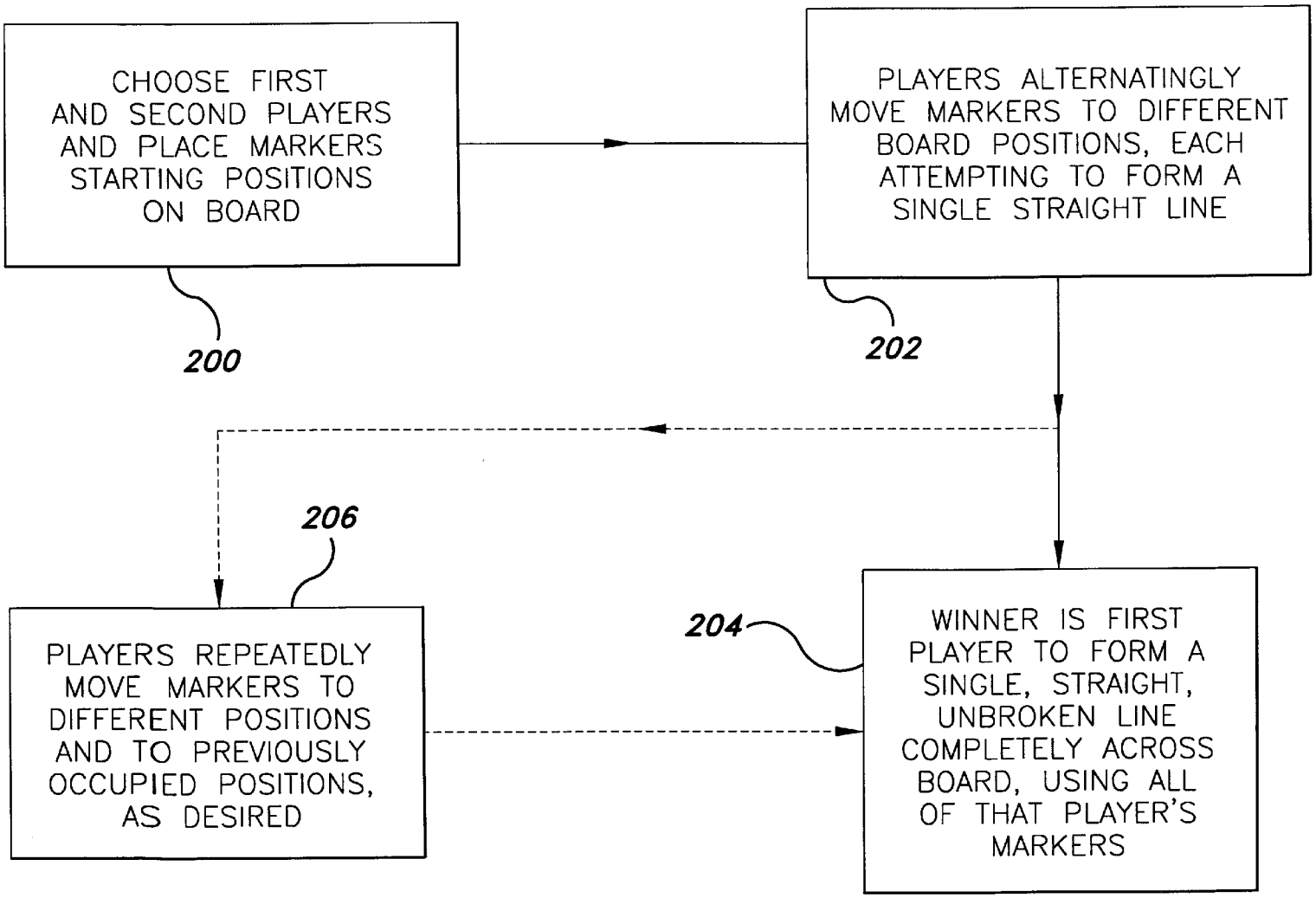
FIG. 7 is a flow chart showing the general steps in the method of play of the present game in each of its embodiments.

The two players determine the order of play, and each selects one of the marker sets 22 or 24 to be used in the course of play of the game. The first and second marker sets 22 and 24 are initially positioned respectively along the first and second starting rows 12 and 14 of the game board 10, respectively by the first player and the second player of the game. This step in the method of play is shown as the first step 200 in the flow chart of FIG. 7.

The object of each of the present game embodiments is to arrange one's player position markers to form a straight line extending completely across the board 10, either laterally, vertically, or diagonally. Thus, a marker set 22 or 24 may be used to form a straight line along either of the two major diagonals 18 or 20, or along any of the three vertical columns a, b, or c. A line may also be formed horizontally, along any row (excluding the corresponding starting row for each marker set, e. g., excluding the first starting row 12 for the first marker set 22, and excluding the second starting row 14 for the second marker set 24).

Thus, the first player could manipulate his/her first marker set 22 to form a horizontal line along either the opposite, second starter row 14 of the second marker set 24, or the intermediate row 16, in the nine position game board 10 of FIG. 1, but could not form a winning line along his/her starting row 12. The second player could play his/her markers 24 to form a horizontal line along the first player's starting row 12 or the intermediate row 16, but not along his/her own starting row 14. Thus, at least two of the player position markers 22 and 24 must be moved from their original starting positions, in order to form a winning line in the nine position board 10 of FIG. 1.

It will be noted that the playing positions of the board 10 of FIG. 1 are each spaced apart and separated by a playing path or lane 26 which extends between them. These paths 26 designate all of the possible winning alignments of the player position markers 22 and 24, and also designate the directions of possible moves.

Each marker may be moved one position at a time in any allowable direction, similarly to the moves allowed for a king in the game of chess. However, no capturing, jumping, or removal of game pieces or position markers is allowed in the present game. Position markers may only move to an adjacent vacant position, one position at a turn, in attempting to form a line of one complete set of player position markers horizontally, vertically, or diagonally across the board. This second step of the method of play of the present game is shown generally by the second step 202 of the flow chart of FIG. 7. The first player to form such a straight line across the board, wins the game, as indicated generally by the third step 204 of the flow chart of FIG. 7.

Figure 2:
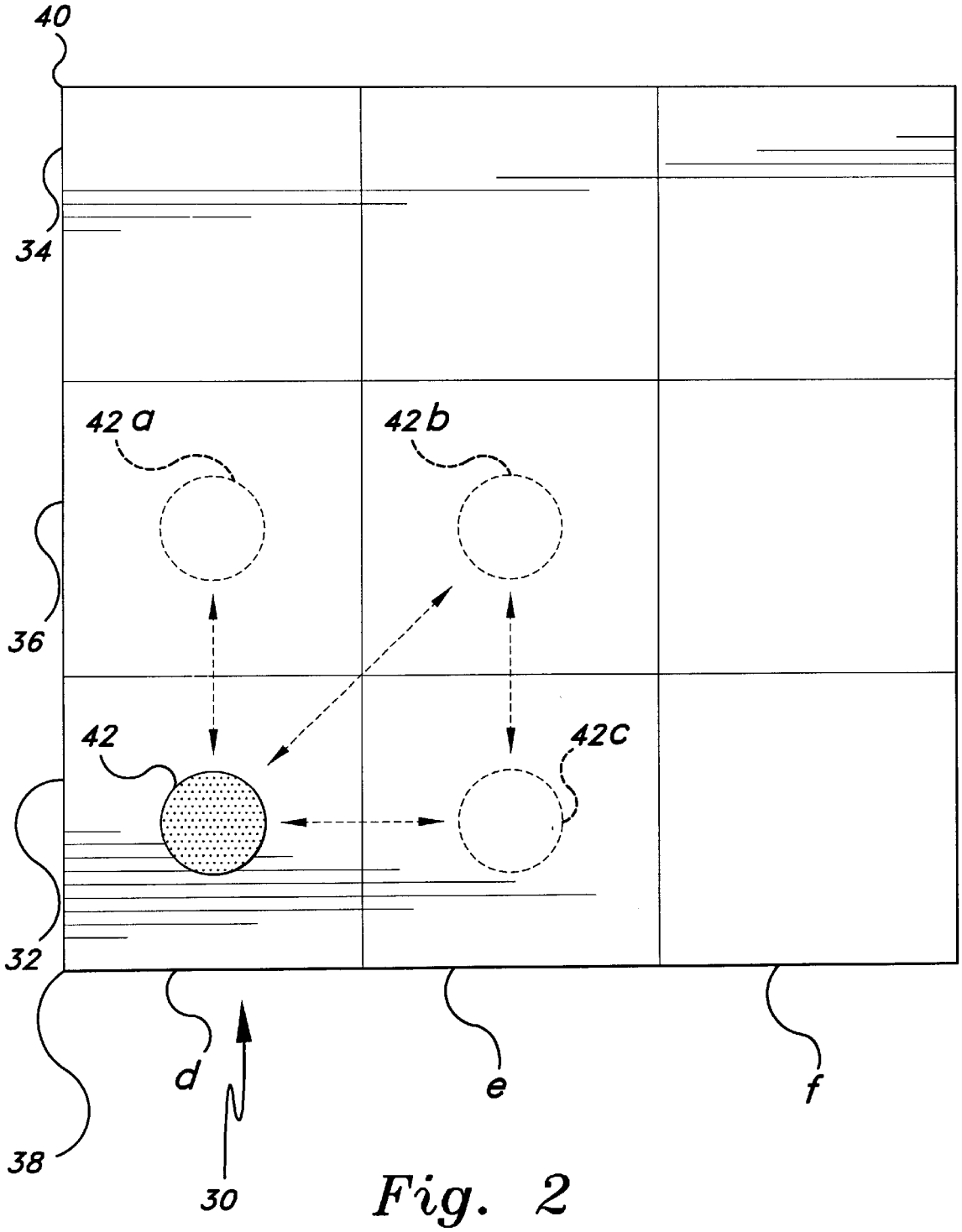
FIG. 2 is a plan view of a second embodiment of the game board of the present game, illustrating a three by three matrix of conterminous playing positions and the allowable positional moves of a player position marker thereon.

FIG. 2 illustrates an alternative embodiment of a game board for the present game, designated as game board 30. The game board 30 is formed of a three by three matrix of conterminous playing positions, and includes a first horizontal or lateral starting row 32, an opposite second starting row 34, and an intermediate row 36. The three columns are designated as the first column d, second column e, and third column f. A first and a second major diagonal, respectively 38 and 40, extend across the board 30 to diagonally opposite corners. While the game board 30 of FIG. 2 does not include playing paths between spaced apart playing positions, the rules of play of the game remain the same. However, the contiguous arrangement of the playing positions may require the momentary displacement of one or more playing pieces during the course of play, if the markers are close to the size of the playing positions.

FIG. 2 also illustrates the various possible moves which may be made by a player position marker 42, which is initially placed upon an initial starting position 32*a*. From this position in the lower left corner of the board 30, there are three possible moves which may be made, as indicated by the arrows extending from the marker 42: Vertically, along the first column d to the intermediate row position 36*d*; diagonally, along the first diagonal 38 to the center position 36*e*; and laterally, to the center position 32*e* of the first starting row 32. These positions are respectively indicated in broken lines as markers 42*a*, 42*b*, and 42*c*. It will also be noted that the arrows indicate that the marker of any of the positions 42*a*, 42*b*, or 42*c* may be moved back to its original starting position at position 32*d*, if so desired, during the course of the game. No limit is placed upon the number of times any of the markers of the present game may be moved, so long as only one marker is moved in each turn, and the marker moved is moved by only one position to an adjacent vacant position.

As multiple moves of a given player position marker over several turns is permitted in the present game, it will be seen that the game may extend over a number of moves, for quite some time, as each player seeks an advantageous arrangement of his/her position markers. This is indicated by the fourth step 206 of the flow chart of FIG. 7. While it is shown as an optional step, indicating that each marker may be moved only once (i. e., to the intermediate row immediately adjacent the starting row), this is not a plausible scenario in the play of the present game.

Figure 3:
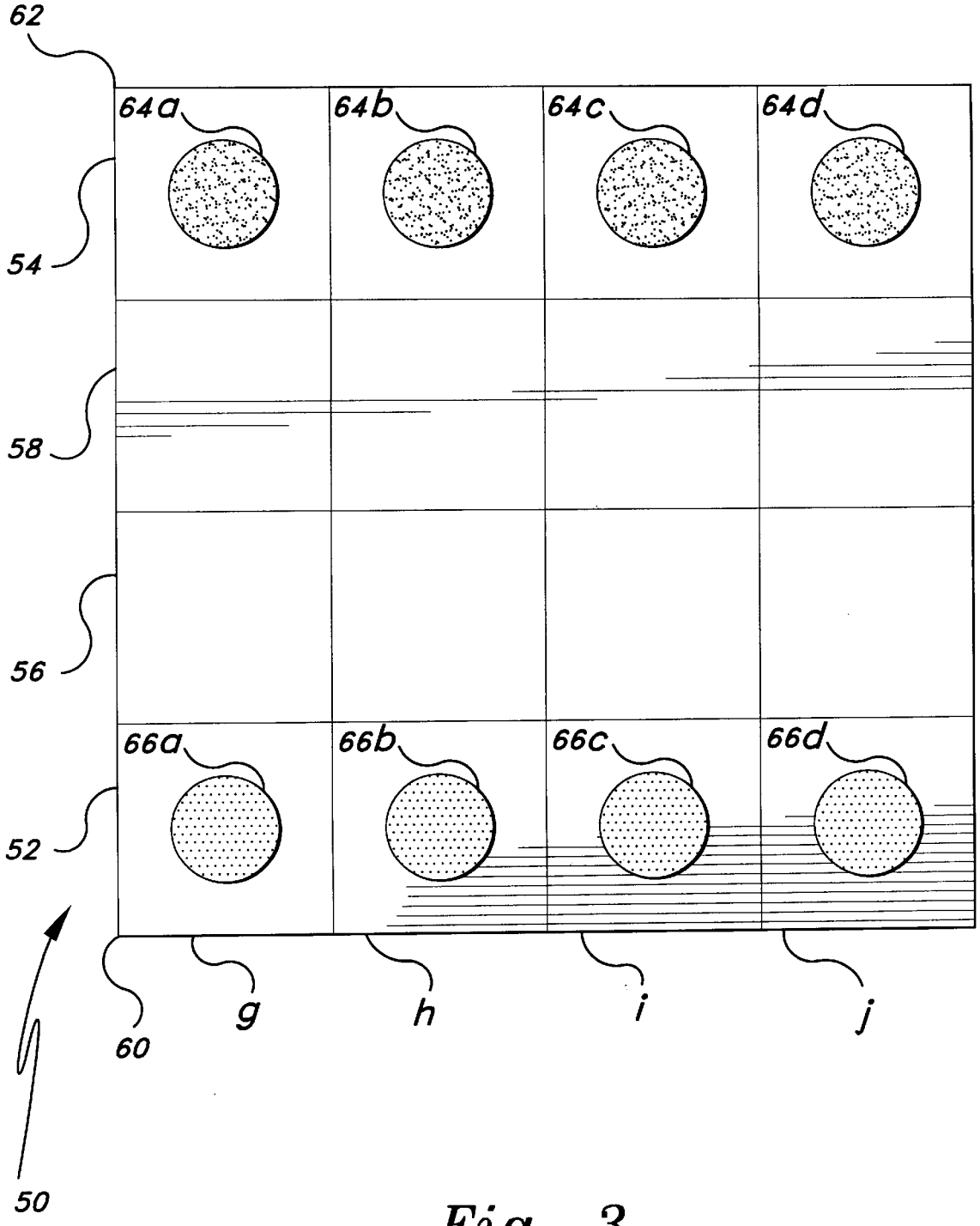
FIG. 3 is a plan view of a third embodiment of a game board of the present game, comprising a four by four matrix of sixteen conterminous playing positions on a game board, with first and second player position markers positioned in their starting positions thereon.

FIG. 3 illustrates a further alternative embodiment of the present game, comprising a game board 50 having a four by four matrix of sixteen conterminous playing positions. The board 50 of FIG. 3 is formed of a first starting row 52, an opposite second starting row 54, and a first and a second intermediate row, respectively 56 and 58. The first through fourth columns are respectively designated as columns g, h, i, and j, and the first and second diagonals are designated respectively as diagonals 60 and 62.

Two sets of markers, respectively comprising first marker set 64*a* through 64*d* and second marker set 66*a* through 66*d*, are arranged respectively along the first starting row 52 and opposite second starting row 54 of the game board 50 of FIG. 3. As in the case of the three by three board matrix of FIG. 1, the number of player position markers provided in each set in FIG. 3, is equal to the number of positions in each row, column, or major diagonal of the board 50 of FIG. 3.

While the game board 50 of FIG. 3 is shown comprising sixteen conterminous playing positions, it will be seen that the playing positions may be spaced apart and separated by a series of playing paths or lanes, similar to the lanes or paths 26 of the game board 10 of FIG. 1, if so desired. Such separating of the playing positions may be advantageous in providing space between adjacent positions for the sliding movement of a player position marker along a path or lane, particularly for diagonal movement.

Also, the number and arrangement of lanes or paths may be limited to limit the movement of markers therealong, if so desired, to add further challenge to the present game, as discussed in greater detail further below. Thus, movement of a marker to an adjacent playing position may require the marker to be moved to a third or intermediate position along one of the playing paths, rather than directly from the first position to a second position. While this is not the case in any of the board embodiments disclosing conterminous playing positions in the present disclosure, such could be provided on such conterminous playing position boards by means of appropriate movement indicators (arrows, dashes, etc.) between playing positions where marker movement is allowed therebetween.

Figure 4:
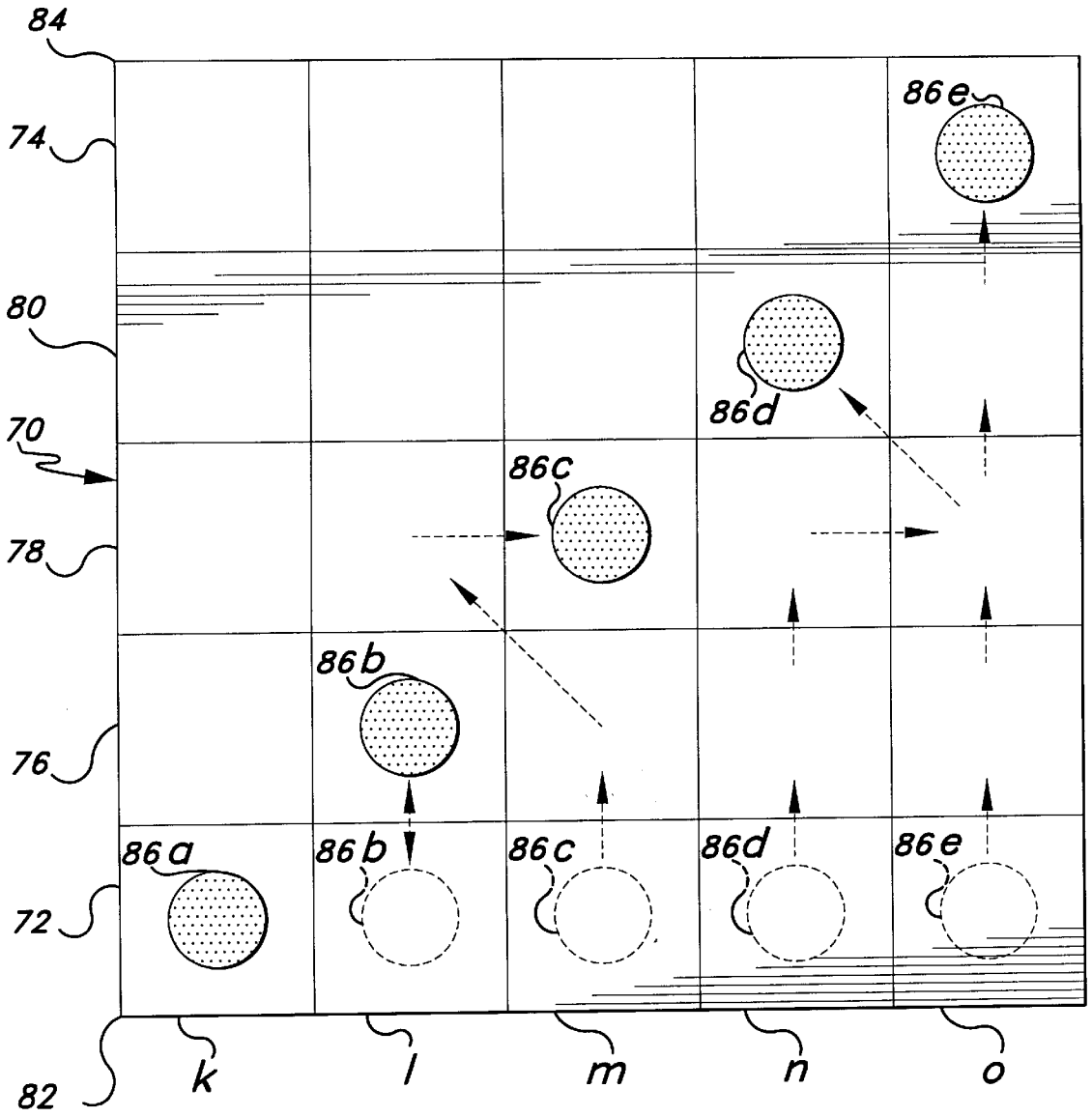
FIG. 4 is a plan view of a fourth embodiment of a game board of the present game, comprising a five by five matrix of twenty five conterminous positions on a game board, with one possible set of moves being shown to position a row of markers from the starting row to a diagonal row on the board.
Figure 5:
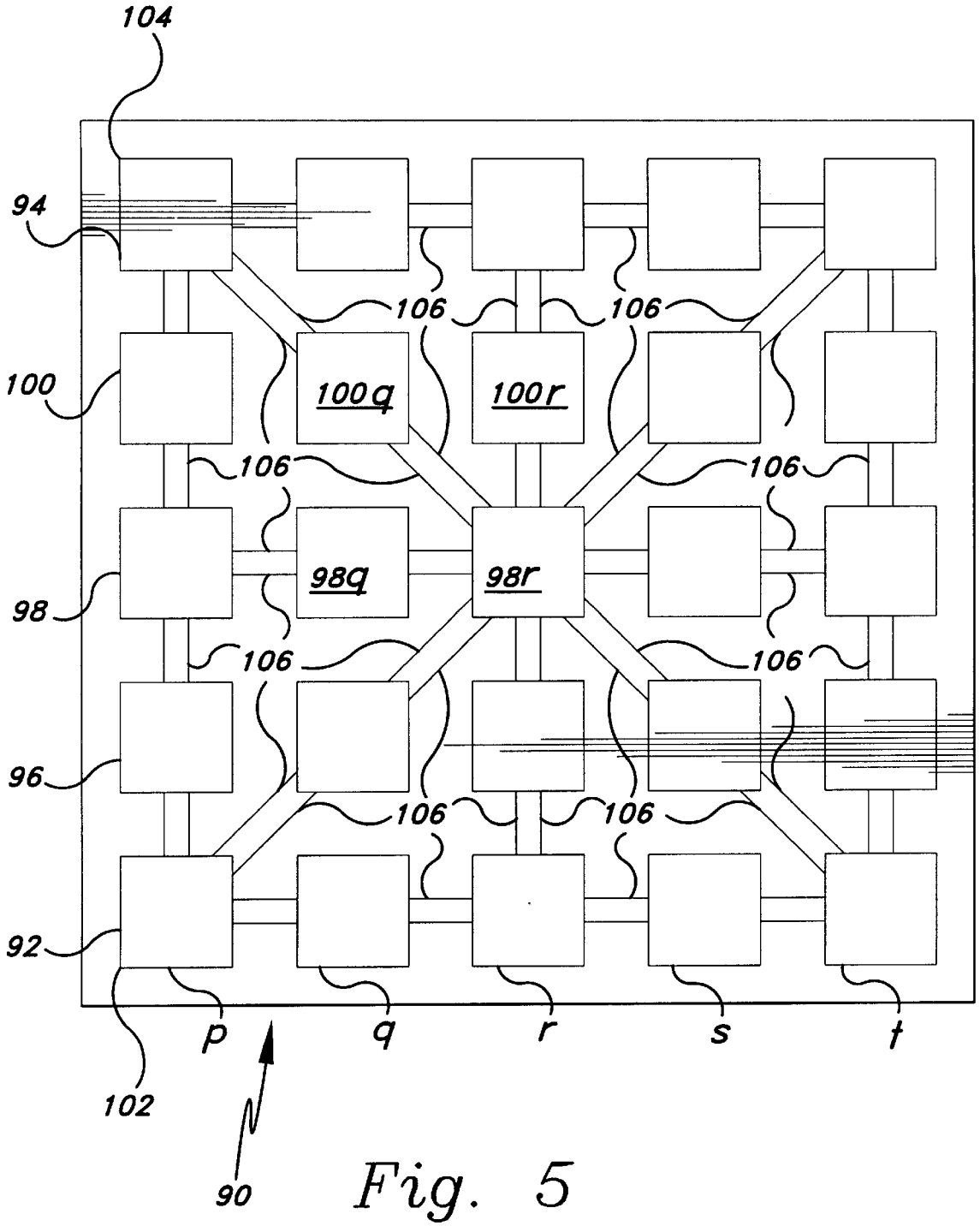
FIG. 5 is a plan view of a fifth embodiment of a game board of the present game, with each of the playing positions being separated by a playing path therebetween, but with certain paths eliminated to restrict movement only to those paths designated.

FIG. 4 provides a plan view of yet another embodiment of a game board of the present game, designated as game board 70. The game board 70 comprises a five by five matrix of playing positions, designated as the first starting row 72, opposite second starting row 74, and first through third intermediate rows 76, 78, and 80. The first through fifth columns are designated respectively as columns k through o, with the first and second major diagonals being designated as diagonals 82 and 84. In FIG. 5, a series of first player position markers 86*a* through 86*e* is shown in a winning end game position, along the first diagonal 82 of the board. The starting positions of each of the markers 86*b* through 86*e* is shown in broken lines respectively along the first starting row positions 72*l* through 72*o*, with the marker 86*a* remaining unmoved.

The arrows displayed over the board 70 of FIG. 4 indicate exemplary marker movements which might be used to achieve the final winning position of the markers 86*a* through 86*e* along the first diagonal 82 of the board 70. It should be understood that the movements shown in FIG. 4, and described below, are exemplary, and that any number of possible or potential moves may be made or required to achieve such a winning position, or other winning position, depending upon the play of the opponent. No opposing markers or moves are shown in FIG. 4, for clarity in the drawing figure.

For example, a first player intending to align his/her markers 86*a* through 86*e* along the first diagonal 82, would likely leave the first marker 86*a* in place in the first starting row corner 72*k*, as shown. The second marker 86*b* would eventually be moved to rest upon the second position 76*l* of the first diagonal 82; it might be necessary to move the marker 86*b* back and forth one or more times, depending upon the actions of the opponent, as indicated by the double ended arrow between the solid and broken line positions of the marker 86*b*. A player might initially move the third marker 86*c* straight up the third column m, to the second position 76*m* of that column, and then move the marker 86*c* diagonally to the left to the position 78*l*, as though he or she is attempting to make a vertical alignment, before moving the marker 86*c* to its final position in the center of the board 70 on position 78*m*, as indicated by the arrows indicating the movement of the marker 86*c*. Again, alternative movements of the marker 86*c* might be used instead.

The fourth marker 86*d* has been moved from its initial position on the position 72*n*, straight up the fourth column n, first to the second position 76*n* in that column, thence to the third position 78*n*, and then laterally to the middle position 78*o* of the fifth column o, before being moved diagonally upwardly and to the left to its final place on the fourth position 80*n* of the first diagonal 82. Finally, the fifth marker 86*e* has been moved straight up the fifth column o, along the positions 76*o* through 80*o*, before being finally placed on the last position 74*o* of the first diagonal 82.

Again, the above described moves are exemplary in nature, and a practically infinite number of alternative moves could be used and described in lieu of those described above. Also, it will be seen that some of the above described paths taken by some of the markers 86*b* through 86*e*, cross over other paths taken by others of the above markers 86*b* through 86*e*. This is acceptable during the course of play of the present game, so long as any position to which a marker is moved, is vacant at the time of the move. It may have been in use on a previous turn, either by an opponent's marker or a marker of the same set, or it may be used in a future turn by an opponent's marker or marker of the same set. However, so long as the position to which a marker is moved is vacant at the time of the move, the play is acceptable.

FIG. 5 illustrates an alternative embodiment of a five by five matrix board, designated as game board 90. Play on the game board 90 is similar to that described above for the game board 70 of FIG. 4, but includes some additional restrictions.

The game board 90 of FIG. 5 comprises a five by five matrix of spaced apart playing positions, formed of a first starting row 92, an opposite second starting row 94, and first through third intermediate rows, respectively 96 through 100. A series of five columns is designated by the letters p through t, for the first through fifth column, with first and second major diagonals 102 and 104 extending across the board 90 to diagonally opposite corners.

The game board 90 also includes a series of first playing paths 106, which extend between at least some of the spaced apart playing positions to connect them together and to designate all possible routes of player position marker movement, as well as some of the possible winning alignments for the game. However, it will be seen that in many cases, adjacent playing positions, e. g., playing positions 100*q*, 98*q*, and 100*r*, are not directly connected by the first playing paths 106. If movement of a playing piece or marker is desired from one such position to a second such position, such movement must be by way of at least one other intermediate position, in order to retain movement of the marker along the designated routes provided by the first paths 106.

In the above example, a position marker located at position 100*q*, to be moved to position 98*q* or 100*r*, would have to be moved downwardly and to the right along the playing path 106 extending between position 100*q* and an intermediate position comprising the center position 98*r* before being moved again to the desired position 98*q* or 100*r*, for a total of two moves. Other examples of the above described intermediate move scenario will be apparent.

It will be seen that the first playing paths 106 of the game board 90 of FIG. 5 do not provide for all possible winning alignments, as well as not providing all possible connections between adjacent playing positions. While the winning alignments of the first and second starting rows 92 and 94, second intermediate row 98, and first, third, and fifth columns p, r, and t are connected by segments of the playing paths or lanes 106, it will be seen that the playing positions of the first and third intermediate rows 96 and 100, as well as the two columns q and s, are not directly connected by such playing paths 106. Nevertheless, winning alignments may be formed along these indirectly connected rows 98 and 100 and columns q and s, as well as along the directly connected rows and columns. However, such winning alignments along such indirectly connected rows and columns will be seen to require more moves to complete, due to the need to make moves to intermediate positions before finally positioning a marker upon an indirectly connected position.

The game board 110 of FIG. 6 provides an alternative embodiment to the board 90 of FIG. 5, in which additional playing paths are provided The game board 110 of FIG. 6 is again formed of a five by five matrix of playing positions, comprising a first starting row 112, opposite second starting row 114, and first, second, and third intermediate rows, respectively 116, 118, and 120. The first through fifth columns are respectively designated as columns u through y, with the first and second major diagonals being respectively designated as diagonals 122 and 124.

A series of first playing paths 126 is provided between each of the playing positions of the first and second starting rows 112 and 114, second intermediate row 118, first, third, and fifth columns u, w, and y, and the two major diagonals 122 and 124, in an arrangement essentially the same as that described for the first playing paths 106 of FIG. 5. The function of these first playing paths 126 of the board 110 of FIG. 6 is the same as that of the first playing paths 106 of FIG. 5, i. e., to indicate the permissible movement paths of the player position markers used in the play of the present game, and to indicate some (but by no means all) of the possible winning alignments for the game.

However, rather than limiting movement to only those first playing paths 126, additional second playing paths 128 may be provided between playing positions of the first and third intermediate rows 116 and 120, and the second and fourth columns v and x, if desired. These secondary playing paths 128, in combination with the first playing paths 126, serve to show every possible winning alignment along all of the rows, columns, and two major diagonals of the game board 110.

Figure 6:
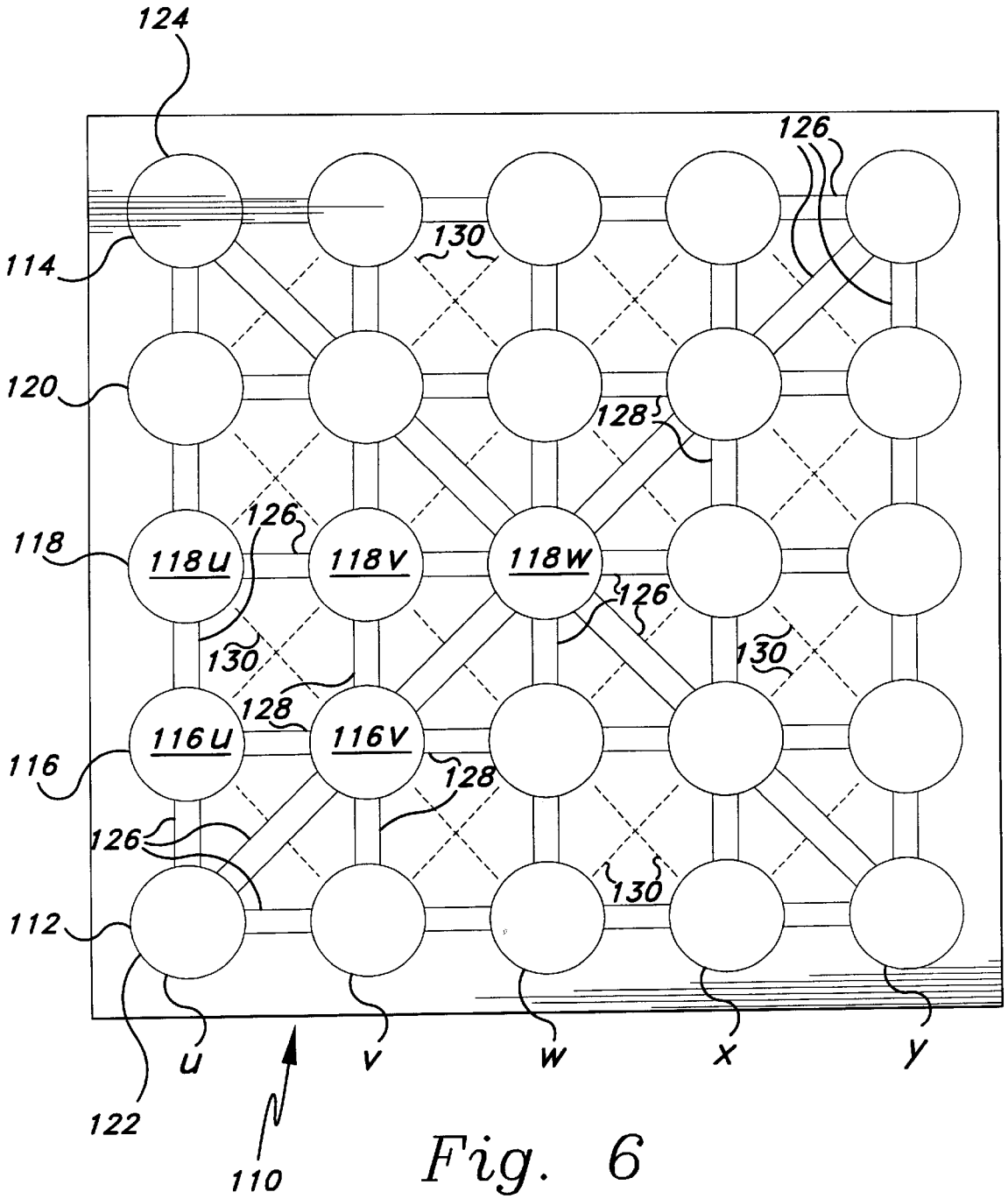
FIG. 6 is a plan view of a sixth embodiment of a game board of the present game, wherein each of the playing positions of a five by five matrix game board is separated by a playing path or lane therebetween to designate the path of travel of player position markers between positions.

However, it will be seen that movement between some of the adjacent positions of the board 110 of FIG. 6, still requires movement to an intermediate position adjacent to both the initial position and final position of the move. An example would be a move from a first position 116*v*, to a diagonally adjacent final position 118*u*, where the two positions 116*v* and 118*u* are separated by a minor diagonal with no primary or secondary path therebetween.

In this case, if only the primary and secondary playing paths or lanes 126 and 128 were provided on the game board 110 of FIG. 6, it would be necessary for the player to move the marker first from the initial position 116*v* to an intermediate position comprising either position 116*u* or 118*v*, using the secondary path 128 extending between the initial position 116*v* and 116*u* or 118*v*. Then, on the next move the marker could be moved from the intermediate position 116*u* or 118*v*, along the appropriate primary or first playing path 126 extending from the position 116*u* or 118*v*, to the final position 118*u*.

If further flexibility in the play of the game is desired, additional third playing paths 130 may be provided between each of the playing positions along the minor diagonals of the game board 110, i. e., diagonals not aligned between the four opposite corners of the board 110 and not passing through the center position 118*w*. These tertiary playing paths 130 do not designate any winning alignment, but may be used to designate all of the possible moves of a marker between any combination of two adjacent positions, along with the first and second playing paths or lanes 126 and 128 described above. In the case of the example described above for a move from the initial position 116*v* to the final position 118*u*, movement along a third, minor diagonal playing path 130 extending directly between the two positions 116*v* and 118*u*, would allow the movement to be accomplished in only a single turn, rather than requiring two turns as in using only the primary and secondary playing paths 126 and 128 as described further above.

In summary, the present strategy board game in each of its various embodiments will be seen to provide a most entertaining and mentally challenging game. While embodiments comprising three by three, four by four, and five by five matrices of playing positions have been disclosed, it will be seen that embodiments comprising higher numbers of playing positions may also be incorporated, using the same principles and rules of play described herein. While in its simplest form the present game may be played on a tic-tac-toe like game board, the allowance of any number of moves by each of the playing pieces or markers makes the present game considerably more interesting and challenging than the old game of tic-tac-toe.

The provision for spacing the player positions apart from one another adds further interest, by also providing for limiting the possible moves between many of the adjacent positions by limiting the arrangement of the playing paths between the positions. This is especially true in the higher ordered matrices of the present game embodiments. Yet, the game in any of its embodiments may allow movement between any two adjacent positions if so desired, just as in the simplest three by three matrix.

While square playing positions are shown in most of the game board embodiments of the present game, other playing position shapes may be provided, as in the round positions of the game board of FIG. 6. Also, the playing positions, playing paths, backgrounds, and position markers of the various game boards may be colored in any number of different contrasting or complementary colors, as desired, without departing from the concept of the game.

Accordingly, the present strategy game will serve to provide many hours of entertainment for persons of all ages, with older players perhaps finding those games having higher ordered matrices in their game boards to be of greater interest. However, the principles, rules, and strategy of play remain essentially the same for all of the embodiments of the present game, regardless of its size or the specific number of playing positions provided on a board. The relationship between these different game embodiments will allow players to play any one of the game board embodiments without being required to learn a new game, thus further increasing interest in the present game.

It is to be understood that the present invention is not limited to the sole embodiments described above, but encompasses any and all embodiments within the scope of the following claims.

We claim:

1. A method of playing a strategy board game, comprising the following steps:

(a) providing a game board having a square matrix of playing positions thereon, comprising equal numbers of playing positions in each row, column, and major diagonal thereof and having a first and a second starting row adjacent opposite edges of the board and at least one intermediate row therebetween;

(b) designating a first player and a second player and the corresponding order of play;

(c) further providing a first set and a second set of selectively movable player position markers corresponding to the first player and the second player, with each set of markers being equal to the number of playing positions in each row, column, or major diagonal of the game board;

(d) placing the first set and the second set of markers along the respective first and second starting row of the game board;

(e) moving any one of the markers longitudinally, laterally, or diagonally as desired selectively in alternating turn by each player, to an adjacent vacant playing position on the board; and (f) continuing to move any one of the markers in turn, with each player attempting to align the corresponding set of markers to form a straight line along the at least one intermediate row, opposite starting row, any column, or major diagonal of the game board to win the game.

2. The method of playing a strategy board game according to claim 1, including the steps of:

(a) separating each of the playing positions of the game board from one another;

(b) providing a playing path between at least some of the adjacent playing positions on the game board, for designating the movement of the player position markers therealong; and (c) connecting all of the playing positions with one another by means of at least one playing path and intermediate playing position, as required.

3. The method of playing a strategy board game according to claim 2, including the step of designating each row, column, and major diagonal by a playing path between adjacent playing positions therealong.

4. The method of playing a strategy board game according to claim 2, including the step of providing a playing path between each two adjacent playing positions on the game board.

5. The method of playing a strategy board game according to claim 1, including the step of providing a game board having a square three by three matrix of playing positions comprising nine playing positions of a first and a second starting row, first intermediate row therebetween, and first through third columns.

6. The method of playing a strategy board game according to claim 1, including the step of providing a game board having a square four by four matrix of playing positions comprising sixteen playing positions of a first and a second starting row, first and second intermediate rows therebetween, and first through fourth columns.

7. The method of playing a strategy board game according to claim 1, including the step of providing a game board having a square five by five matrix of playing positions comprising twenty five playing positions of a first and a second starting row, first through third intermediate rows therebetween, and first through fifth columns.

8. The method of playing a strategy board game according to claim 7, including the steps of:

(a) separating each of the playing positions of the game board from one another; and (b) connecting each of the playing positions of the first and second starting rows, the second intermediate row, the first, third, and fifth columns, and the two major diagonals by first playing paths therebetween for designating movement of the player position markers therealong and for further designating at least some winning alignments of player position markers on the board.

9. The method of playing a strategy board game according to claim 8, including the step of providing a second playing path between each playing position along the first and third intermediate rows and the second and fourth columns, for designating with the first playing paths further movement of the player position markers therealong and all of the possible winning alignments of player position markers along each of the intermediate rows and all of the columns of the game board.

10. The method of playing a strategy board game according to claim 9, including the step of providing a third playing path between each diagonally adjacent playing position along each of the minor diagonals of the game board, for designating with the first and second playing paths all of the permissible moves of player position markers therealong.

* * * * *